United States Patent [19]

Fulford

[11] 4,206,520

[45] Jun. 10, 1980

[54] DOUCHE APPLIANCE

[76] Inventor: John Fulford, 10 Sunset Point Dr., Mittagong, N.S.W. 2575, Australia

[21] Appl. No.: 970,167

[22] Filed: Dec. 18, 1978

[30] Foreign Application Priority Data

| | | | |
|---|---|---|---|
| Jan. 23, 1978 | [AU] | Australia | 32658/78 |
| May 10, 1978 | [AU] | Australia | 35968/78 |
| Sep. 15, 1978 | [AU] | Australia | PD5967 |

[51] Int. Cl.[2] ..... A47K 3/22; A47K 11/08

[52] U.S. Cl. ..... 4/665; 4/420.2

[58] Field of Search ..... 4/6, 7

[56] References Cited

U.S. PATENT DOCUMENTS

| | | | |
|---|---|---|---|
| 1,014,787 | 1/1912 | Torossian | 4/7 |
| 1,091,499 | 3/1914 | Friedman | 4/7 |
| 1,855,008 | 4/1932 | Callejo | 4/7 |
| 1,935,201 | 11/1933 | Callejo | 4/7 |
| 2,094,170 | 9/1937 | Heald | 4/7 |
| 2,872,687 | 2/1959 | Maurer | 4/7 |
| 3,398,408 | 8/1968 | Capraro et al. | 4/7 |
| 3,594,826 | 7/1971 | Maurer | 4/7 |
| 3,662,407 | 5/1972 | Colucci | 4/7 |

*Primary Examiner*—Henry K. Artis

*Attorney, Agent, or Firm*—Stevens, Davis, Miller & Mosher

[57] ABSTRACT

A douche appliance connectable to the pan of a water closet comprises a spray arm assembly including a retractable water conduit having one end attached to a spray head and extending into the water closet pan and another end connected to a pressurized water supply; an instantaneous heating, thermostatically controlled electric heater provided in flow line between the pressurized water supply and retractable conduit; and, an electric body parts dryer selectively coupled to an interior space defined by the pan or to a location suitable for drying a user's hands.

17 Claims, 7 Drawing Figures

DOUCHE APPLIANCE

This invention relates to douche appliances connectable to pans of water closet suites and has for its object the provision of such an appliance which can be comparatively easily installed in association with a new or an existing water closet suite of standard kind to incorporate therewith the function of a bidet.

Spray-arm assemblies incorporated into water closet suites to allow the pan to be used bidet-fashion have been previously proposed. For example, Australian patent application No. 66,107/74 discloses a douche appliance connectable to the pan of a water closet suite in which the spray-arm is swung from the operative position over the side of the pan. Thus the user must rise from the seat after defecating to enable the spray-arm to be put to use, or he must defecate over the sprayhead.

Either course is unsatisfactory, and it appears that the use of this appliance is purely as a bidet with no real facilities for washing the nether parts after defecating. In Australian patent specification No. 242,243 there is described and claimed a highly complex water closet appliance which includes a slidable spray-arm and a hot air generating unit both integral with a massive pan structure. Pressure on a foot pedal causes the cycle to start up and the spray-arm assembly is moved to the operative position by means of water pressure. The mechanisms involved will be seen to be quite complicated, rendering the appliance a costly installation out of the financial reach of the average householder.

As far as the present applicant is aware, there does not appear to exist a compact and inexpensive douche appliance which can be connected to an existing or new water closet suite pan of standard type, and which can be satisfactorily cleansed as the pan is flushed.

Thus, in accordance with the present invention there is provided a douche appliance connectable to the pan of a water closet suite, comprising: a spray-arm assembly including a duct; a conduit extending through the duct, spaced co-axially therein and adapted to extend into the pan through the wall thereof; a sprayhead at one end of the conduit, positionable in the pan; and the other end of the conduit being in communication with a source of water under pressure.

Preferably, the conduit is movable from an inoperative position in which the sprayhead is located under the sparging lip of the pan to an operative position in which the sprayhead is located substantially centrally of the pan. A thermostatically-controlled water heater of 'instantaneous' type may be provided in the flow-line between the source of water under pressure and the conduit.

In a further embodiment of the present invention, there may be incorporated an electrically-operated body parts drier, the warm air duct of which is, in a first mode of operation, enabled to communicate with the interior of the pan and, in a second mode of operation, enabled to communicate with atmosphere: the arrangement being such that, in the first mode of operation, a stream of warm air is directable onto the nether body parts of a user whereas, in the second mode of operation, the stream is directable to atmosphere to enable the hands of a user to be dried. The spray-arm assembly duct may extend between the pan and a cabinet in which the water heater and/or the body parts drier is/are contained; the conduit being movable by means of a handle which protrudes through a slot in a wall of the cabinet so as to be actuatable from the outside: the cabinet itself may be free-standing or affixable to a wall. Ideally, a thermal cut-out is provided on the water heater so that power to the heater is switched off when water pressure drops to a predetermined minimum.

The spray-arm assembly conduit may also be arranged to be movable about its longitudinal axis to thus cause the sprayhead to move through an arc; to this end the slot along which the handle travels to longitudinally move the conduit from inoperative to operative position has a contiguous transverse extension at its end nearest the pan so that the handle, at that limit of its travel, is enabled to be moved vertically so as to cause the sprayhead to move through the said arc. The douche appliance may also have a solenoid valve-operated injector, the tank of which is adapted to contain a wetting agent, a vaginal deodorant or a mixture of both; the outlet nozzle of the injector tank is in communication with the spray-arm assembly conduit.

In a still further embodiment of the present invention, the douche appliance may be additionally provided with a hand-basin, advantageously mounted atop the cabinet, and associated with this hand-basin a water-outlet spout, the waste pipe of the hand-basin being adapted to drain into the warm air duct leading into the pan; and a two-way valve provided in the flow-line between the heater and the spray-arm assembly conduit, water to the said water-outlet spout being deliverable via a conduit in communication with an outlet of the two-way valve. The existing cistern of the water-closet suite may be interposed between the heater and the source of water under pressure, water to the heater being deliverable thereto from the overflow outlet of the cistern by means of an electric pump, the inflow end of the overflow outlet being disposed below minimum water level in the cistern.

In yet a further embodiment of the present invention the spray-arm assembly of the douche appliance may be provided with at least one O-ring seal between the conduit and the duct, and with an annular water-outlet manifold having a number of bores communicating with the interior of the duct. Ideally, this manifold is comprised of a collar on the conduit, which collar carries thereon a said O-ring seal. It will be found to be particularly advantageous if each bore of the said manifold is arranged to incline towards the sprayhead.

Each end of the duct preferably has an end-cap, each end-cap having a central bore and a said O-ring mounted therein through which the conduit is able to slide, each end-cap also being provided with an internal shoulder having an inside diameter less than the outside diameter of the manifold. Preferably, one of the end-caps is internally threaded so that it can be screwably attached to a correspondingly-threaded end of the duct but wherein the other of the end-caps is adapted to be push-fitted onto the other, plain, end of the duct and subsequently bonded thereto.

The sprayhead itself may be comprised of a cap member having a bore adapted to be push-fitted onto the sprayhead end of the conduit and subsequently bonded thereto, this bore being in communication with a chamber of diameter less than that of the bore so as to form therebetween an internal shoulder; a bore through the wall of the chamber constituting the spray orifice of the sprayhead.

In order that the reader may gain a better understanding of the invention, hereinafter are described some preferred embodiments of it, by way of example only and with reference to the accompanying drawings, in which.

Figure 1:
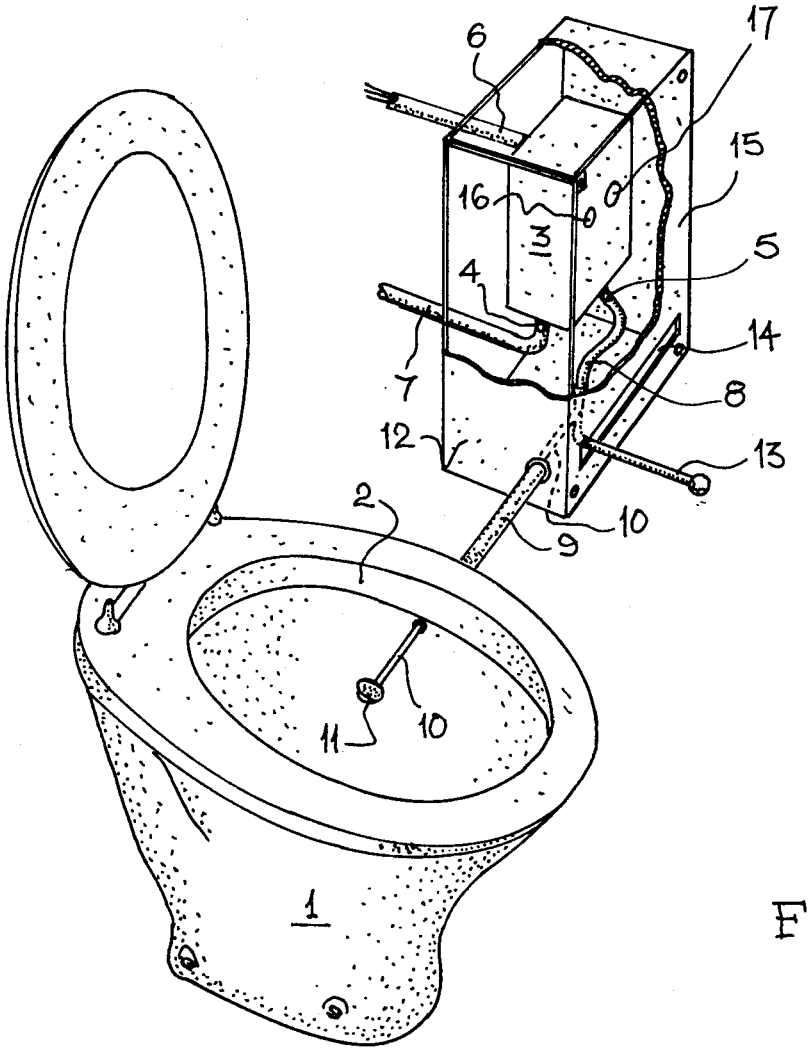
FIG. 1 is a perspective view of a douche appliance according to the present invention, in a first embodiment, installed with respect to a standard water closet suite pan at the right-hand side.

Shown in FIG. 1 is a standard water closet suite pan 1 with the usual sparging lip 2. The douche appliance includes a thermostatically-controlled water heater of the 'instantaneous' type 3 provided with an inlet 4, an outlet 5 and a power inlet 6. Line 7 from a source of water under pressure connects to water inlet 4; this source may be such as 'town's water,' that is to say, mains water or it may be from tankage via a suitable pressure pump or from a sufficiently elevated header tank.

Pressurized water line 7 connects to the heater inlet to the tank and the heater outlet 5 is in communication with a flexible conduit or tube 8 which supplies spray-arm assembly 9, 10 with water. This spray-arm assembly includes a duct 9 through which is longitudinally slidable a conduit 10 which conveys water from flexible tube 8 to a sprayhead 11.

Duct 9 extends between pan 1 and a cabinet 12 within which heater 3 is installed and the conduit 10 extends into pan 1 through a suitably drilled aperture into which duct 9 is secured by a typical conventional arrangement such as an arrangement of threaded rings. Preferably spray-arm assembly 9, 10 is inclined slightly downwardly towards pan 1 so that residual water will drain naturally into the pan 1 after use.

Conduit 10, sliding in duct 9, is movable from an inoperative position in which sprayhead 11 is located under sparging lip 2 of pan 1 to an operative position in which it is located substantially centrally of the pan 1, which is the position shown in FIG. 1. Conduit 10 is made to move in and out of pan 1 by operation of a handle 13 which protrudes through a suitable horizontal slot 14 in the cover 15 of cabinet 12.

Heater 3 is actuated by pushing button 16 which causes a solenoid valve to open to thus admit water to a pre-set temperature-control valve 17 and thence supplies warmed water to flexible tube 8, all in conventional manner.

Cabinet 12 may be contructed of such as metal, timber or suitable plastics material. Ideally, water heater 3 is provided with a thermal cut-out, which is generally incorporated in such heaters, so that electricity supply is automatically switched off should the water pressure drop to a hazardous level.

The thermostatically-controlled 'instantaneous' water heater 3 may advantageously be subjected to modification as follows: instead of the user being required to manually push the button 16 to supply a flow of warm water to the spray-on assembly 9, 10, a microswitch of known kind may be installed within cabinet 12 for operation by handle 13. When handle 13 is moved into the inoperative position the microswitch is tripped so as to turn off water heater 3 and when handle 13 is moved into the operative position the microswitch is activated so as to turn on water heater 3. Preferably slot 14 has, at its 'inoperative position' end, a downwardly-directed extension into which handle 13 is slotted to contact the microswitch.

Furthermore, when the douche appliance according to the present invention is to be used in tropical areas, an additional heater control may be advantageously incorporated within heater 3. This additional control may consist in a rheostat and potentiometer arrangement operable to reduce the voltage applied to heater 3, the better to control the temperature of the water emerging from the spray-arm assembly.

With the two above-described modifications, the button 16 and the valve 17 may be enclosed within cabinet 12, only the spindle and an operating knob of the rheostat being now external of cabinet 12 for the purpose of manual control.

It may be advantageous to incorporate in the spray-arm assembly a suitable spring means to return conduit 10 to the inoperative position; alternatively it may be actuated by an appropriate mechanical or electrical device.

Figure 2:
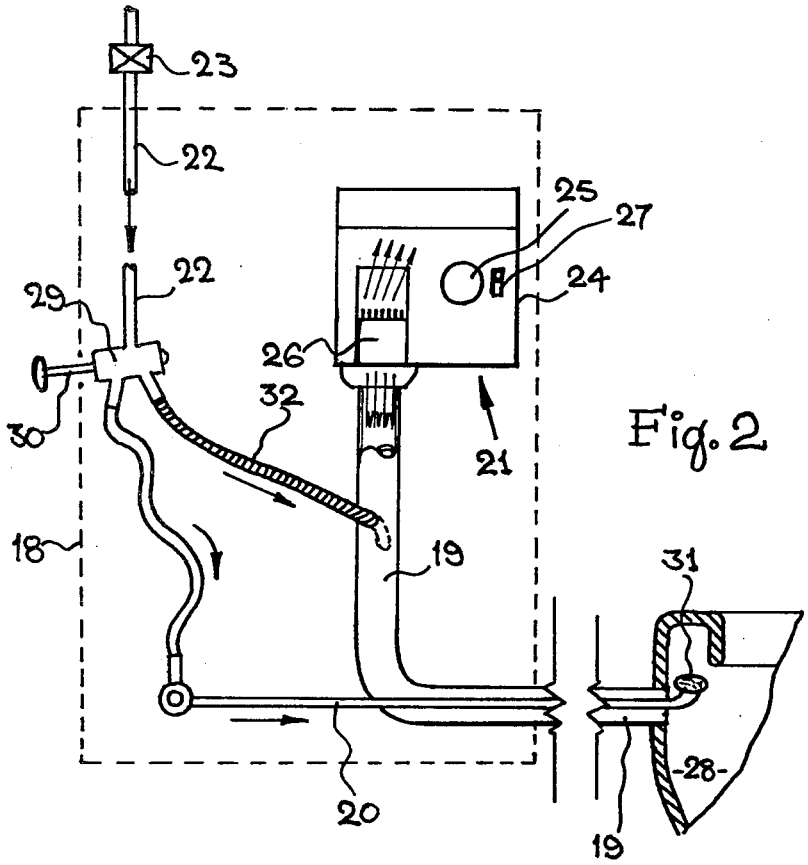
FIG. 2 is a schematic representation of a second embodiment.

In FIG. 2 there is shown, in a somewhat schematic manner, a representation of a second embodiment of the invention. Within a suitable wall-mounted or free-standing cabinet indicated in chain line and referenced 18 there is provided a spray-arm assembly having a conduit 20 and an electrically-operated body parts drier 21. Conduit 20 is supplied with water under pressure, as described with reference to FIG. 1, via piping 22 controlled by a suitable cock or valve 23 all in a manner well known in the plumbing art. As beforesaid, this source of water under pressure may be 'town's water ' or it may be from tankage via a header tank or pressure pump, perhaps in association with a septic tank system where town's water is not available.

Body parts drier 21 is of the kind having a high-speed electric motor and a centrifugal fan operating at about 6,500 r.p.m., contained in a casing 24. Such a drier is usually capable of delivering 160 c.f.m. of air at a temperature of about 55° C. Motor and fan are turned on and off by pressing the operating button 25.

Drier 21 has an air diverter 26 journalled in casing 24 and operable manually to direct the air stream either downwardly or outwardly in known manner and as required.

As will be made clear, in the first mode of operation, the downwardly-directed air stream is usable to dry the nether body-parts of a user and, in the second mode of operation, to dry the hands of the user. A manually-operated time-switch 27 provides either a 2½–3 minute drying time for drying the nether body-parts or a 30-second drying time for the hands.

The downwardly-directed air stream is led to the interior of the water closet suite pan 28, through the wall thereof, via warm air duct 19.

Preferably, between the source of water under pressure and conduit 20, there is a two-way valve 29 operable by a push-pull spindle device 30 and associated knob to enable duct 19 to be flushed and cleansed in the event of fouling by faecal matter. To this end, a conduit 32, conveniently flexible, is led from valve 29 into communication with duct 19.

Turning now to FIG. 3, there is shown, again in schematic manner, a third embodiment of the invention. Within a suitable wall-mounted or free-standing casing or housing indicated in chain line and referenced 33 there is provided a spray-arm assembly having a conduit 35 and an electrically-operated body parts drier 36. Body parts drier 36 has a casing, operating button, air-diverter and manually-operated time-switch all just as described with reference to body parts drier 21 shown in FIG. 2. Spray-arm conduit 35 is supplied from a source of water under pressure, either 'town's water' or tank water as before but, in this embodiment, there is interposed, between the water source and conduit 35, a cistern 37 of the water closet suite, an electric pump 38 and a thermostatically-controlled water heater of the 'instantaneous' type 39. Water is deliverable firstly to pump 38 via a conduit 40 which is connected to the overflow outlet 41 of cistern 37. The inflow end 42 of overflow outlet 41 is disposed below minimum water-level in cistern 37.

When pump 38 is switched on, water is pumped from cistern 37 via conduits 40 and 43 to the heater 39. Heater 39 is a thermostatically-controlled solenoid valve heater of a well-known kind and has an on-off push button 44 which actuates pump 38 to pump water from cistern 37 to heater 39. Water temperature is controlled by rotating control knob 45.

In the flow-line between heater 39 and conduit 35 there is provided a two-way valve 46 operated by a pull-push spindle 47 to supply warm water through a flexible conduit or tube 48 to a water-outlet spout 49 associated with a hand-basin 50 mounted atop of cabinet or housing 33. The other outlet of the two-way valve 46 supplies water from heater 39 to conduit 35 of the spray-arm assembly.

Downwardly-directed air from the air diverter of body parts drier 36, in a first mode of operation, passes via warm air duct 51 to the interior of pan 52 of the water closet suite, through the wall thereof, and, in a second mode of operation, air is directed outwardly to enable the hands of a user to be dried.

Waste pipe 53 of hand-basin 50 communicates with duct 34 both to empty hand-basin 50 and to allow the outlet of 34 to be flushed and cleansed to thus prevent fouling by faecal matter.

Positioned between heater 39 and drier 36 within cabinet 33 there may advantageously be an injector 55 of the kind often incorporated into certain washing machines. Injector 55 comprises a tank 56 with a filling inlet 57 and a solenoid valve-operated outlet nozzle 58 which is in communication with spray-arm assembly conduit 35 via a flexible conduit 59. Tank 56 of injector 55 is filled with either a wetting agent, a vaginal deodorant or a mixture of both.

The purpose behind the use of a wetting agent in tank 56 of injector 55 is to prevent the formation of discrete water droplets on the nether portions of the body, these being more difficult to dry satisfactorily than is the film produced by use of the wetting agent.

Operation of push-button 44 to switch heater 39 on also actuates the solenoid valve associated with outlet nozzle 58 to open and cause a small aliquot of the contents of tank 56 to be injected into the conduit leading to spray-arm assembly conduit 35.

As previously described with reference to FIG. 1, control knob 45 and push-button 44 may be enclosed within cabinet or housing 33 and the heater 39 switched on and off by a handle-operated microswitch just as before; again water temperature may be selected by the rheostat/potentiometer arrangement hereinbefore described.

Figure 4:
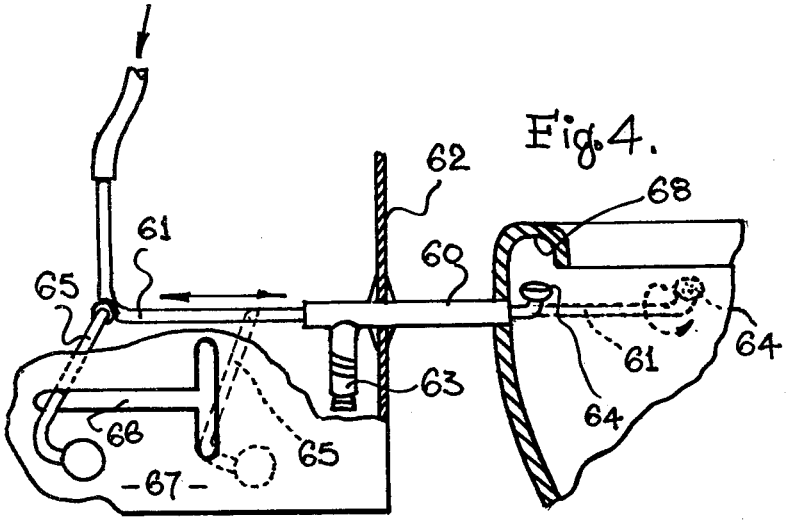
FIG. 4 shows the spray-arm assembly and support in greater detail.
Figure 3:
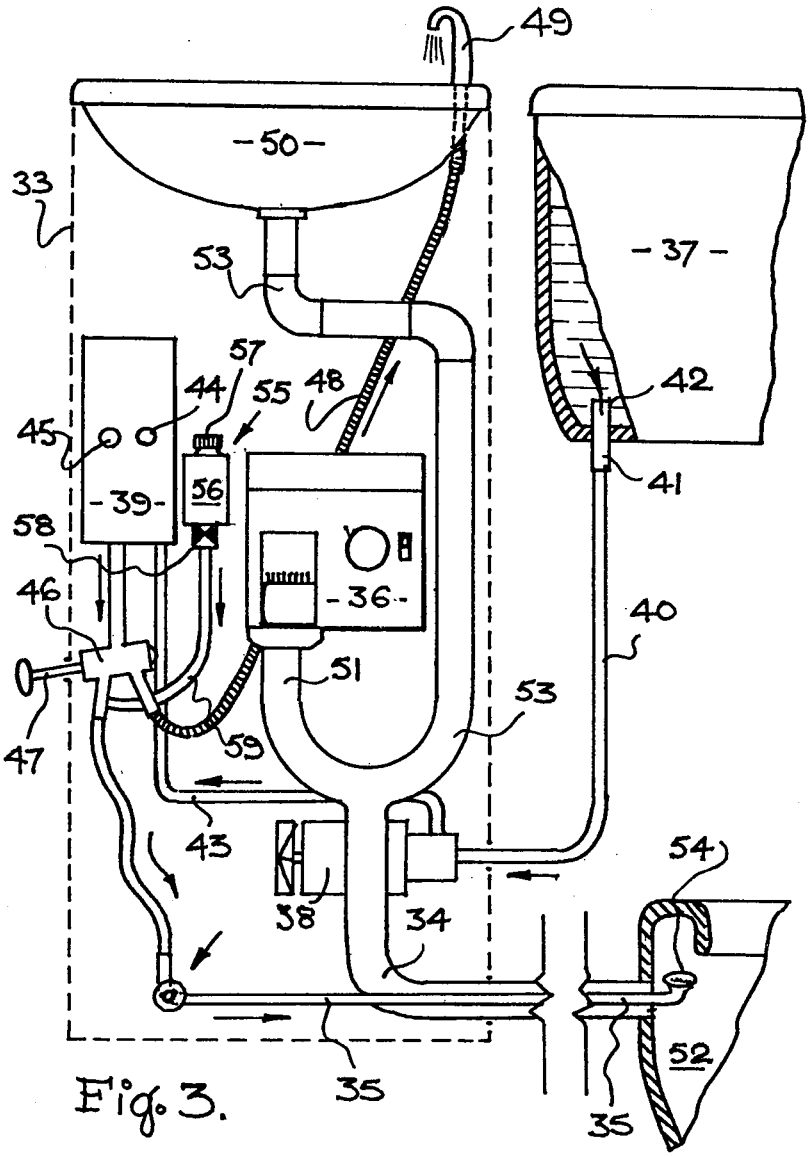
FIG. 3 is a schematic representation of a third embodiment.

FIG. 4 shows the construction of the spray-arm assembly shown in the previous figures in a little more detail. This spray-arm assembly comprises the duct, referenced 60, and conduit sliding within it as previously described and adapted to extend in the pan of a water closet suite through the wall thereof. Duct 60 is secured into a suitably drilled aperture in the pan wall by means of some typically conventional arrangement such as an arrangement of threaded rings or by such means as epoxy resin adhesive. This aperture, as well as that required to accommodate the outlet end of the warm air duct, may be made by a diamond-tipped drill. It will be realised that, in FIGS. 2 and 3, the spray-arm assembly duct, referenced 9 in FIG. 1 and 60 in FIG. 4, has been omitted in the interests of greater clarity. Returning now to consideration of FIG. 4, duct 60 passes through a wall 62 of the cabinet or housing and is affixed to the floor thereof by means of a support member 63. Support member 63 may take any one of a variety of forms but it is ideally adjustable both vertically and laterally (that is to say, in a direction parallel to wall 62) in order to accurately position duct 60 to pass cleanly through its receiving aperture in the wall of the pan which is, of course, spatially fixed once it has been drilled in the pan wall. Conduit 61 is fitted at the 'pan end' with a sprayhead 64 and, at its other end, is in communication with the heater as illustrated in FIGS. 2 and 3. On the 'cabinet end' of conduit 61 there is secured an operating handle 65 which protrudes through a T-shaped slot 66 in wall 67 of the cabinet (this may best be seen, referenced 66, in FIG. 5). Conduit 61 is movable longitudinally through duct 60, by means of rod or handle 65, from an inoperative position in which sprayhead 64 is located under the sparging lip 68 of the pan (shown in solid line) to an operative position in which sprayhead 64 is located substantially centrally of the pan (shown in broken line). Additionally, when sprayhead 64 is in the operative position, it is movable through an arc by rocking conduit 61 by moving handle 65 with an up-and-down motion in the vertical portion of T-shaped slot 66. Thus, efficient cleaning of the anal and genital regions of a user's body is the better achieved.

As will be realized, slot 66 may have, at its inoperative end, a downwardly-directed extension into which handle 65 is slotted to contact a suitable microswitch which turns the water heater on or off as previously described with reference to FIG. 1.

To ensure adequate drainage, conduit 61, along with duct 60, has a slight downfall between cabinet and pan, as also has the warm air duct (19 in FIG. 2 and 34 in FIG. 3).

Conduit 61 may be spring-biased, if required, to return sprayhead 64 to the inoperative position after use, or a suitable, and known, electrical device may be incorporated to operate it instead of its being operated manually by handle 65.

In the outlet end of the warm air duct there may be journalled a movable baffle or a like means to direct outflowing air selectively onto a user's nether body parts and also to create some degree of turbulence to the flushing flow of water, the better to cleanse the outlet.

It will also be realised that, particularly in areas subject to cool or cold weather condition, the drier may be used to warm the water closet seat with the warm air stream for the greater comfort of the user thereof.

Figure 5:
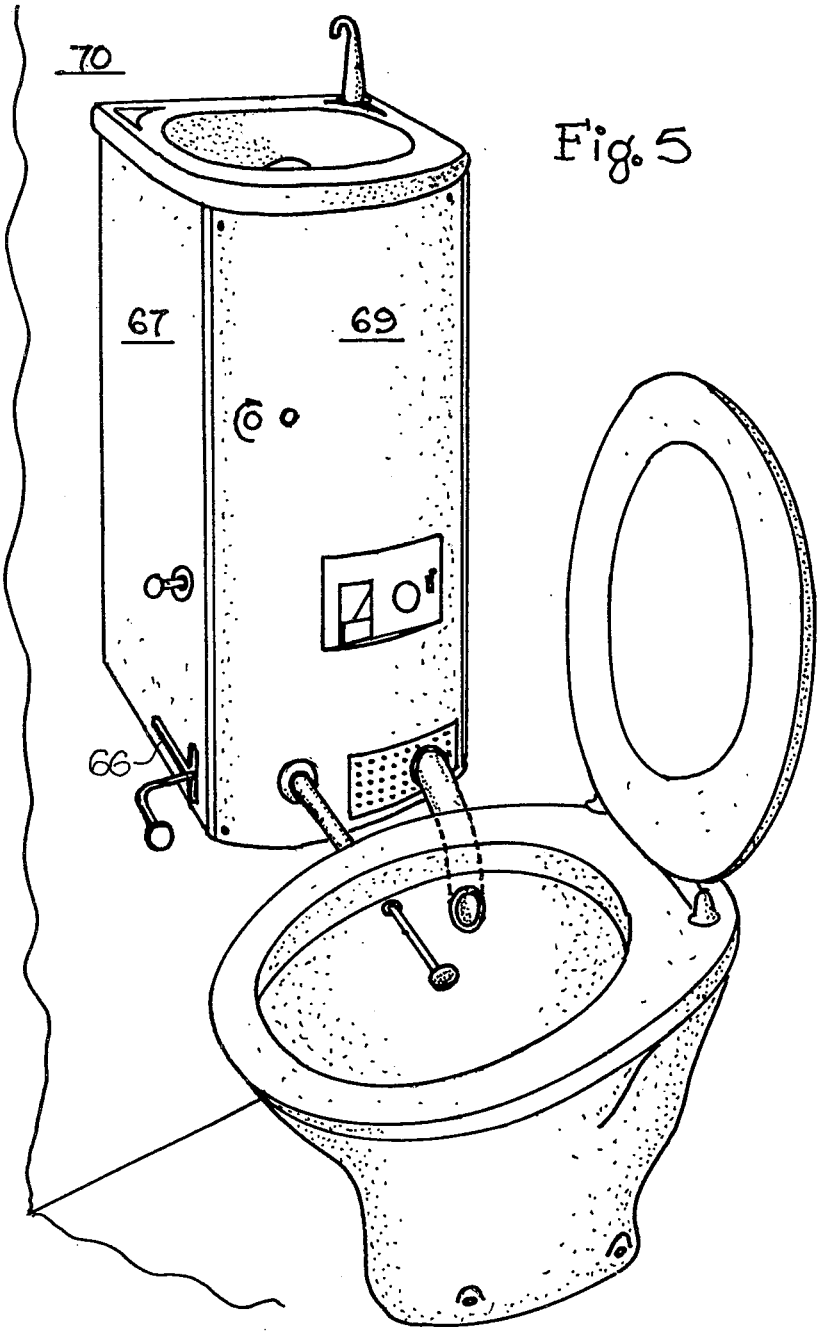
FIG. 5 is a perspective view of a douche appliance installed with respect to a standard water closet suite pan at the left-hand side.

FIG. 5 is a general perspective view of the invention connected to the pan of a water closet suite. The cabinet has an access panel 69 which is easily removable for maintenance of the components within, as is also the cabinet wall 67, and is shown affixed to a wall 70 of a toilet room; however, it may equally well be free-standing on suitable legs or other supports, preferably affixed to the floor of the said toilet room.

Figure 6:
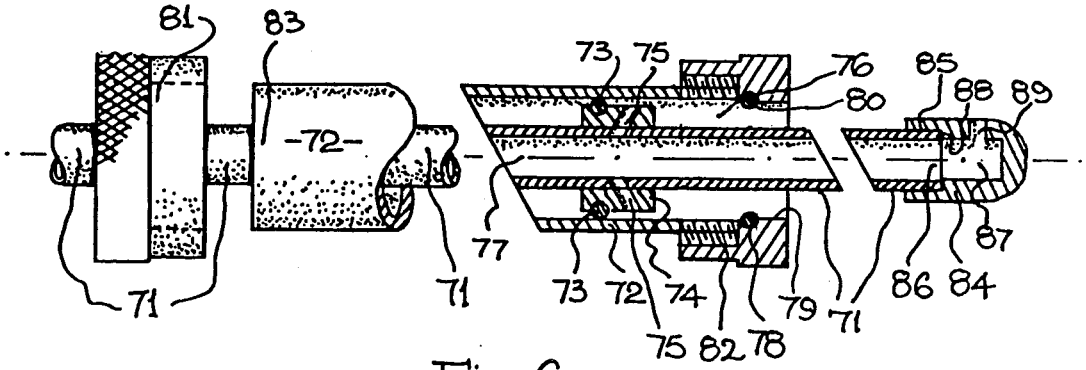
FIG. 6 is an elevation, partly in section and partly exploded, of a further embodiment of a spray-arm assembly; and, FIG. 7 shows how an actuating handle may be made adaptable to either right-hand or left-hand installation.

FIG. 6 illustrates, partly in section and partly 'exploded,' an embodiment of the spray-arm assembly comprised of a duct and a conduit therethrough and co-axial therewith.

In the previously described embodiments, the conduit is a 'snug' sliding fit within the duct, but in the embodiment illustrated in FIG. 6, a conduit 71 has an outside diameter a good deal less than the inside diameter of an associated duct 72 and is spaced co-axially within it by an O-ring 73 carried upon a collar. This collar is comprised of an annular water outlet manifold 74 having a number of bores 75 communicating with the interior 76 of duct 72 and also with the interior 77 of conduit 71. As will be seen from FIG. 6, the bores 75 are inclined towards the sprayhead end of conduit 71.

At each end of duct 72 there is a knurled-edge end-cap having a central bore through which conduit 71 is able to slide, and these caps are used to connect the ends of duct 72 to the cabinet and to the pan respectively.

End-cap 78 at the pan of duct 72 is internally threaded as shown and screws onto the correspondingly-threaded end of duct 72. End-cap 78 is provided with an internal shoulder 79 which bears an O-ring 80 against which manifold 74 sealingly abuts to limit 'pan-ward' movement of conduit 71 through duct 72 at the pan end.

End-cap 81 at the water supply end of duct 72 is not internally-threaded as is end-cap 78, as is to be seen later herein. End-cap 81 is provided with an O-ring (not shown) to further seal the annular space between conduit 71 and the duct 72.

Manifold 74 operates in the following manner: when the water closet pan has been used, a cleansing spray of water is caused to emerge from the sprayhead; this spray is given suitable force since bores 75 in manifold 74 are substantially inoperative by reason of their juxtaposition hard against end-cap 78. However, as conduit 71 is moved into its inoperative position, bores 75 are freed to spray water therefrom to flush the sprayhead end of conduit 71 as it is withdrawn into duct 72.

A further advantage will be seen to accrue from the above-described arrangement—as bores 75 become operative by being freed from constraint, the force of the water emerging from the sprayhead decreases such that the user of the pan does not receive an unwanted spray across the underside of one thigh.

Toilet rooms vary in width greatly and water closet pans themselves may show considerable variation in their geometry; thus it will be appreciated that the provision of an arrangement whereby both ducts and conduits may be 'tailored' in situ to fit various water closet installations will present a decided advantage.

To this end, the duct 72—referring again to FIG. 6—may be supplied in a number of standard, predetermined lengths; a length of duct 72 has one end threaded, as at 82, to co-act with end-cap 78 but has its other end 83 plain. The water supply end cap 81 is not internally-threaded, as has been stated, but is a push-fit on end 83 of duct 72, being secured thereon by a bonding material such as epoxy resin adhesive. Thus, the length of duct may be cut in situ to accord with the distance between cabinet and pan.

It is contemplated that the conduit will be made available complete with a fitting suitable for connection to a flexible conduit and with a handle for moving the conduit longitudinally through the duct.

The conduit may be supplied open-ended, without an associated sprayhead. In FIG. 6 there is shown a cap member 84 having a bore 85 dimensioned to fit over the end 86 of conduit 71 and to be secured thereon by such as epoxy resin adhesive. Bore 85 communicates with a chamber 87 of lesser diameter and shoulder 88 so formed constitutes a stop means which prevents cap member 84 from being pushed too for onto end 86 of conduit 71. A bore 89 through the wall of chamber 87 provides a spray orifice. Thus, the conduit may also be cut in situ to accord with both the length of the associated duct and the width of the pan of the water closet suite.

Figure 7:
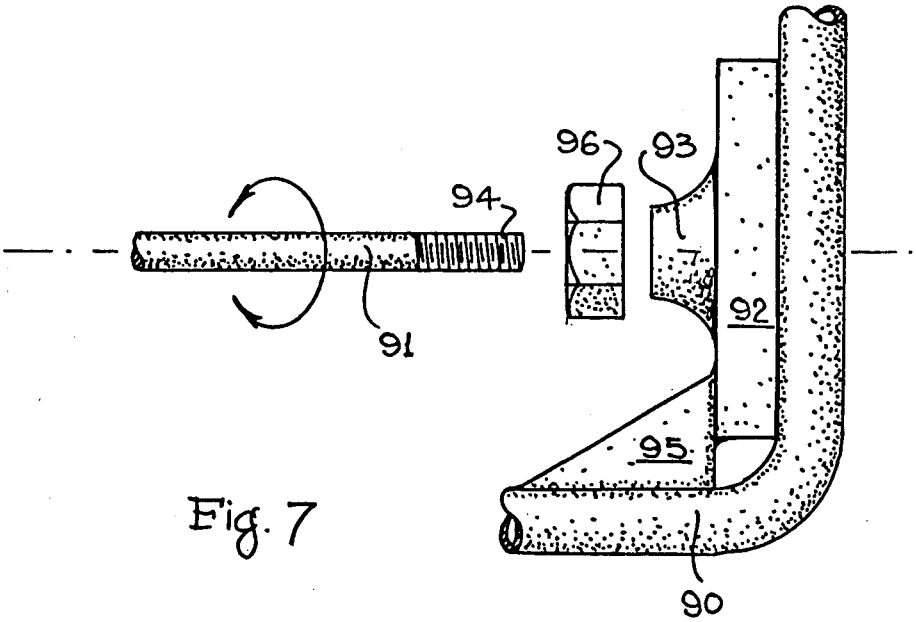

Referring now in particular to FIG. 7, it will be appreciated that the cabinet—see FIGS. 1 and 4—may be required to be installed to the right or to the left of a water closet suite pan to which the spray-arm assembly is to be connected, and accordingly the operating handle of the conduit will correspondingly be required to extend in either of two directions. In order to accomplish this, the conduit fitting 90, to which rod member 91 of the handle is to be attached, is provided with a plate 92, perhaps soldered or otherwise thereto and on plate 92 a boss 93; plate 92 and boss 93 are tapped to screwably receive the threaded end 94 of rod member 91. Plate 92 may be the more securely affixed to fitting 90 by the provision of a strengthening gusset 95.

As will be clearly seen in FIG. 4, the handle has in it a right-angle bend, and in the embodiment illustrated in FIG. 7 may be swung through 180° to thus project either to one side or to the other of plate 92 as required. Rod 91 of the handle can be tightened down to plate 92 and boss 93 by such means as the lock-nut 96.

The device or appliance according to the present invention may, as will be understood, be operated in a number of ways; the following, as an example only, represents a typical cycle of operations in the use of the appliance as embodied in FIG. 3 of the drawings:

(1) After using water closet with sprayhead 54 in the inoperative position, move sprayhead 54 to the operative position.

(2) Press button 44 with spindle 47 pushed in to momentarily run residual cold water to waste.

(3) Pull out spindle 47 to connect heated water to conduit 35 and rotate it by moving the handle up and down until the nether body parts are thoroughly cleansed—perhaps for 30 seconds.

(4) Move conduit 35 to the inoperative position.

(5) Activate drier 36 in the first mode of operation in 2½–3 minute time sequence.

(6) Press in spindle 47 to supply warm water to spout to wash hands.

(7) Press button 44 to turn heater 39 off.

(8) Flush water closet pan.

The present invention offers numerous advantages over the prior art appliances, to name but a few:

(A) The appliance according to the present invention may be relatively easily installed in association with an existing water closet suite or incorporated into a new one.

(B) Many of the parts thereof are commercially obtainable components.

(C) In the inoperative position the sprayhead is readily cleansed by flushing as it is then located under the sparging lip of the pan.

(D) The appliance has few moving parts.

(E) All the electrical connections and wiring are located well clear of wet areas.

(F) The controls are readily accessible to a user of the water closet and are easily reached by such as invalids and children.

(G) The spray-arm assembly and warm air duct can be inserted into the pan in a variety of positions such as 40° to right or left of centre and so on as required for a satisfactory working arrangement.

It will be readily understood that the various embodiments fully described herein are not to be construed as limiting in any way, for example, douche and drier may be combined with the heater, or with the hand basin and without the heater; in tropical areas, for instance, water supply is commonly warm enough to dispense with the heater and in other situations there may already be a hand-basin installed adjacent the water closet suite: thus several such variations are contemplated within the framework of the accompanying claims.

I claim:

1. A douche appliance connectable to the pan of a water closet suite, said pan including a sparging lip, comprising:

a spray-arm assembly including a conduit guide duct, a conduit co-axially extending through said conduit guide duct which is extendable into said pan through a wall thereof, a sprayhead on one end of said conduit extendable into said pan with said conduit, and a means for connecting the other end of said conduit to a pressurized water supply, said conduit being movable from an inoperative non-extended position in which said sprayhead is located under said sparging lip to an operative extended position in which said sprayhead is located substantially centrally of said pan;

an instantaneous heating, thermostatically-controlled water heater provided in a flow line between said pressurized water supply and said other end of said conduit; and, an electrically-operated body parts drier having a warm air outlet which, in a first operating mode, is coupled via a warm air duct to an interior space of said pan and, in a second operating mode, is coupled to the atmosphere at a location suitable for the drying of a user's hands.

2. The douche appliance as claimed in claim 1, wherein said spray-arm assembly duct extends between said pan and a cabinet in which said water heater and body parts drier are contained; and said spray-arm assembly conduit is movable by means of a handle which protrudes through a slot in a wall of said cabinet, thereby being actuatable from outside said cabinet.

3. The douche appliance as claimed in claim 2, wherein said cabinet is either affixable to a wall of a room in which said water closet suite is situated or free-standingly affixable to the floor thereof.

4. The douche appliance as claimed in claim 2, wherein said water heater is provided with a thermal cut-out, whereby the electricity supply to said heater is switched off when water pressure drops to a predetermined minimum.

5. The douche appliance as claimed in claim 1, further comprising a hand-basin having an associated water-outlet spout and a waste pipe draining into said duct leading into said pan interior space; and, a two-way valve provided in said flowline between said heater and said spray-arm assembly conduit, water to said wateroutlet spout being deliverable via a conduit in communication with an outlet of said two-way valve.

6. The douche appliance as claimed in claim 5, wherein said hand-basin is mounted atop a cabinet in which said water heater and drier are contained.

7. The douche appliance as claimed in claim 1, wherein a cistern of said water closet suite is interposed between said heater and said pressurized water supply, water to said heater being deliverable thereto from the overflow outlet of said cistern by means of an electric pump, the inflow end of said overflow outlet being disposed below a minimum water level in said cistern.

8. The douche appliance as claimed in claim 1, further comprising a solenoid valve-operated injector having a fluid outlet communicating with said spray-arm assembly conduit, and a tank containing one of a wetting agent, a vaginal deodorant or a mixture of both fluid connected to the inlet of said injector.

9. The douche appliance as claimed in claim 1, wherein said spray-arm assembly conduit is movable about its longitudinal axis, causing said sprayhead to move through an arc.

10. The douche appliance as claimed in claim 9, wherein said slot has a contiguous transverse extension at its end nearest said pan, said handle, at that limit of its travel, being vertically movable within said transverse slot extension so as to cause said sprayhead to move through said arc.

11. The douche appliance as claimed in claim 1, wherein said spray-arm assembly is provided with at least one O-ring between said conduit and said conduit guide duct, and with an annular water-outlet manifold having a number of bores communicating with the interior of said conduit guide duct.

12. The douche appliance as claimed in claim 11, wherein said manifold is comprised of a collar on said conduit, which collar carries thereon a said O-ring seal.

13. The douche appliance as claimed in claim 11, wherein each bore of said manifold is inclined towards said sprayhead.

14. The douche appliance as claimed in claim 11, wherein an end-cap is provided at each end of said conduit guide duct, each said end-cap having a central bore, through which said conduit extends, and an internal shoulder bearing a said O-ring against which said manifold is able to sealingly abut.

15. The douche appliance as claimed in claim 14, wherein one of said end-caps is internally threaded to enable it to be screwably attached to a correspondingly-threaded end of said conduit guide duct but wherein the other of said end-caps is adapted to be push-fitted onto the other, plain, end of said conduit guide duct and subsequently bonded thereto.

16. The douche appliance as claimed in claim 1, wherein said sprayhead is comprised of a cap member having a core adapted to be push-fitted onto the sprayhead end of said conduit and subsequently bonded thereto, said bore being in communication with a chamber of diameter less than that of said bore to form therebetween an internal shoulder; a bore through the wall of said chamber constituting the spray orifice of said sprayhead.

17. The douche appliance as claimed in claim 1, wherein said water heater is operated by means of a microswitch mounted within said cabinet, said microswitch being operable to switch said water heater on when said handle is moved to an operative position and to switch said water heater off when said handle is moved to an inoperative position.

* * * * *